US009073116B2

(12) United States Patent
Marica et al.

(10) Patent No.: US 9,073,116 B2
(45) Date of Patent: Jul. 7, 2015

(54) CARBON FOAM METAL MATRIX COMPOSITE AND MUD PUMP EMPLOYING SAME

(75) Inventors: Adrian Marica, Cypress, TX (US); Kenneth S. Kondo, League City, TX (US)

(73) Assignee: NATIONAL OILWELL VARCO, L.P., Houston, TX (US)

( * ) Notice: Subject to any disclaimer, the term of this patent is extended or adjusted under 35 U.S.C. 154(b) by 679 days.

(21) Appl. No.: 13/493,163

(22) Filed: Jun. 11, 2012

(65) Prior Publication Data

US 2013/0327574 A1 Dec. 12, 2013

(51) Int. Cl.

| | |
|---|---|
| ***F16J 1/16*** | (2006.01) |
| ***F16J 1/22*** | (2006.01) |
| ***F01B 3/00*** | (2006.01) |
| ***F04B 1/047*** | (2006.01) |
| ***B22D 19/02*** | (2006.01) |

(52) U.S. Cl.

CPC ..... *B22D 19/02* (2013.01); *Y10T 428/12007* (2015.01)

(58) Field of Classification Search

CPC ..... F16J 1/16; F16J 1/22; F01B 3/0023; F01B 3/0026; F04B 1/0472; Y10T 428/12007; B22D 19/02

See application file for complete search history.

(56) References Cited

U.S. PATENT DOCUMENTS

| | | | | |
|---|---|---|---|---|
| 2,076,138 | A * | 4/1937 | Zilen | 254/361 |
| 3,953,647 | A | 4/1976 | Brennan et al. | |
| 5,469,776 | A * | 11/1995 | Martensen et al. | 92/170.1 |
| 5,704,272 | A * | 1/1998 | Durako et al. | 92/57 |
| 5,758,566 | A * | 6/1998 | Jepsen et al. | 92/187 |
| 6,635,339 | B1 * | 10/2003 | Adler et al. | 428/307.7 |
| 7,290,506 | B2 * | 11/2007 | Rau et al. | 123/41.84 |
| 2002/0092151 | A1 * | 7/2002 | Sugiura et al. | 29/527.6 |
| 2003/0164206 | A1 | 9/2003 | Cornie et al. | |
| 2005/0103827 | A1 | 5/2005 | Twigg | |
| 2007/0231576 | A1 * | 10/2007 | Davis et al. | 428/412 |
| 2011/0027612 | A1 * | 2/2011 | Funaki et al. | 428/676 |

FOREIGN PATENT DOCUMENTS

| | | | |
|---|---|---|---|
| CA | 2080377 | A1 | 10/1991 |
| WO | 2006/113762 | A2 | 10/2006 |

OTHER PUBLICATIONS

Canadian Office Action dated Dec. 16, 2014; Canadian Application No. 2,818,270 (3 p.).

Canadian Office Action dated Jan. 8, 2014; Canadian Application No. 2,818,270 (3 p.).

* cited by examiner

*Primary Examiner* — Nathaniel Wiehe
*Assistant Examiner* — Qi Gan
(74) *Attorney, Agent, or Firm* — Conley Rose, P.C.

(57) ABSTRACT

A method for manufacturing a metal reinforced open cell carbon foam component comprises (a) placing a block of open cell carbon foam in a mold. The block comprise a plurality of interconnected pores distributed throughout the block. In addition, the method comprises (b) pouring a molten metal into the mold. Further, the method comprises (c) infiltrating the interconnected pores in the block during (b). Still further, the method comprises (d) allowing the molten metal to cool after (c) to form a metal reinforced open cell carbon foam casting.

11 Claims, 7 Drawing Sheets

CARBON FOAM METAL MATRIX COMPOSITE AND MUD PUMP EMPLOYING SAME

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND

1. Field of the Invention

The invention relates generally to carbon foam metal matrix composite materials. More particularly, the invention relates to drilling mud pumps that employ carbon foam metal matrix composites as reinforcing materials to enhance durability and operating lifetime.

2. Background of the Technology

To obtain hydrocarbons such as oil and gas, boreholes are drilled by rotating a drill bit attached to a drillstring. The drill bit is typically mounted on the lower end of the drillstring as part of a bottomhole assembly (BHA) and is rotated by rotating the drillstring at the surface or by actuation of downhole motors or turbines, or by both methods. With weight applied to the drillstring, the rotating drill bit engages the earthen formation and proceeds to form a borehole along a path toward a target zone.

During drilling operations, drilling fluid, or "mud" as it is also known, is pumped down through the drill string and into the hole through the drill bit. The drilling fluid exits the drill bit through nozzles or jet assemblies positioned in bores formed in the body of the bit. Drilling fluids are used to lubricate the drill bit and keep it cool. The drilling mud also cleans the bit, balances pressure, and carries sludge and formation cuttings created during the drilling process to the surface.

Pumps, typically referred to as slush or mud pumps, are commonly used for pumping the drilling mud. Such pumps used in these applications are typically reciprocating pumps of the duplex or triplex type. A duplex pump has two reciprocating pistons that each force drilling mud into a discharge line, while a triplex reciprocating pump has three pistons that force drilling mud into a discharge line. These reciprocating mud pumps can be single acting, in which drilling mud is discharged on alternate strokes, or double acting, in which each stroke discharges drilling mud.

In most mud pumps, a connecting rod extends between each piston and a reciprocating member that drives the movement of the piston within the corresponding cylinder. In some cases, an insert disposed in a mating recess of the reciprocating member pivotally supports the end of the connecting rod coupled to the reciprocating member. The insert also supports axial loads that are transferred between the reciprocating member and the piston via the connecting rod. A lubrication passage is provided in the reciprocating member and the insert to provide lubrication to the interface between the insert and the end of the connecting rod. In such pumps, the connecting rod is often made from hardened steel, the reciprocating member is often made from cast steel, and the insert is often made from bronze. Friction from the sliding engagement of the connecting rod and the insert during pumping operations creates heat that, over time, can detrimentally affect the insert, and hence the connection between the rod and the reciprocating member. For example, the combination of thermal stress and axial loads may induce cracking in the insert, particularly at the lubrication passage of the insert. Such cracks may propagate and increase in size over time, potentially leading to failure of the insert and/or damage to the mud pump.

Accordingly, there remains a need in the art for improved materials for supporting loads between a connecting rod and a reciprocating member of a mud pump. Such materials would be particularly well-received if they offered the potential to reduce friction and resulting heat between the connecting rod and the insert, and enhance the durability of the connection between the reciprocating member and the connecting rod.

BRIEF SUMMARY OF THE DISCLOSURE

These and other needs in the art are addressed in one embodiment by a method for manufacturing a metal reinforced open cell carbon foam component. In an embodiment, the method comprises (a) placing a block of open cell carbon foam in a mold. The block comprises a plurality of interconnected pores distributed throughout the block. In addition, the method comprises (b) pouring a molten metal into the mold. Further, the method comprises (c) infiltrating the interconnected pores in the block during (b). Still further, the method comprises (d) allowing the molten metal to cool after (c) to form a metal reinforced open cell carbon foam casting.

These and other needs in the art are addressed in another embodiment by an apparatus. In an embodiment, the apparatus comprises a first component. In addition, the apparatus comprises an insert seated in a recess in the first component. The insert is made of a casting comprising an open cell carbon foam and a metal dispersed throughout a plurality of interconnected pores in the open cell carbon foam. The metal comprises at least one of bronze or steel. Further, the apparatus comprises a second component slidingly engaging the insert. The second component is made of steel.

These and other needs in the art are addressed in another embodiment by a pump for pumping drilling fluid. In an embodiment, the pump comprises a housing. In addition, the pump comprises a plurality of pumping assemblies disposed within the housing. Each pumping assembly includes a cylinder coupled to the housing, a piston disposed within the cylinder, a reciprocating member, and a connecting rod. The reciprocating member includes a body and an insert seated in a counterbore in the body. The insert includes a semi-spherical recess. The connecting rod has a first end coupled to the piston and a second end comprising a spherical ball slidingly engaging the semi-spherical recess of the insert. The insert is made of a casting comprising a metal reinforced open cell carbon foam. Further, the pump comprises at least one drilling fluid inlet configured to distribute drilling fluid to the pumping assemblies. Still further, the pump comprises at least one drilling fluid outlet configured to supply pressurized drilling fluid from the pumping assemblies.

Embodiments described herein comprise a combination of features and advantages intended to address various shortcomings associated with certain prior devices, systems, and methods. The foregoing has outlined rather broadly the features and technical advantages of the invention in order that the detailed description of the invention that follows may be better understood. The various characteristics described above, as well as other features, will be readily apparent to those skilled in the art upon reading the following detailed description, and by referring to the accompanying drawings.

It should be appreciated by those skilled in the art that the conception and the specific embodiments disclosed may be readily utilized as a basis for modifying or designing other structures for carrying out the same purposes of the invention. It should also be realized by those skilled in the art that such equivalent constructions do not depart from the spirit and scope of the invention as set forth in the appended claims.

BRIEF DESCRIPTION OF THE DRAWINGS

For a detailed description of the preferred embodiments of the invention, reference will now be made to the accompanying drawings in which.

DETAILED DESCRIPTION OF THE PREFERRED EMBODIMENTS

Figure 1:
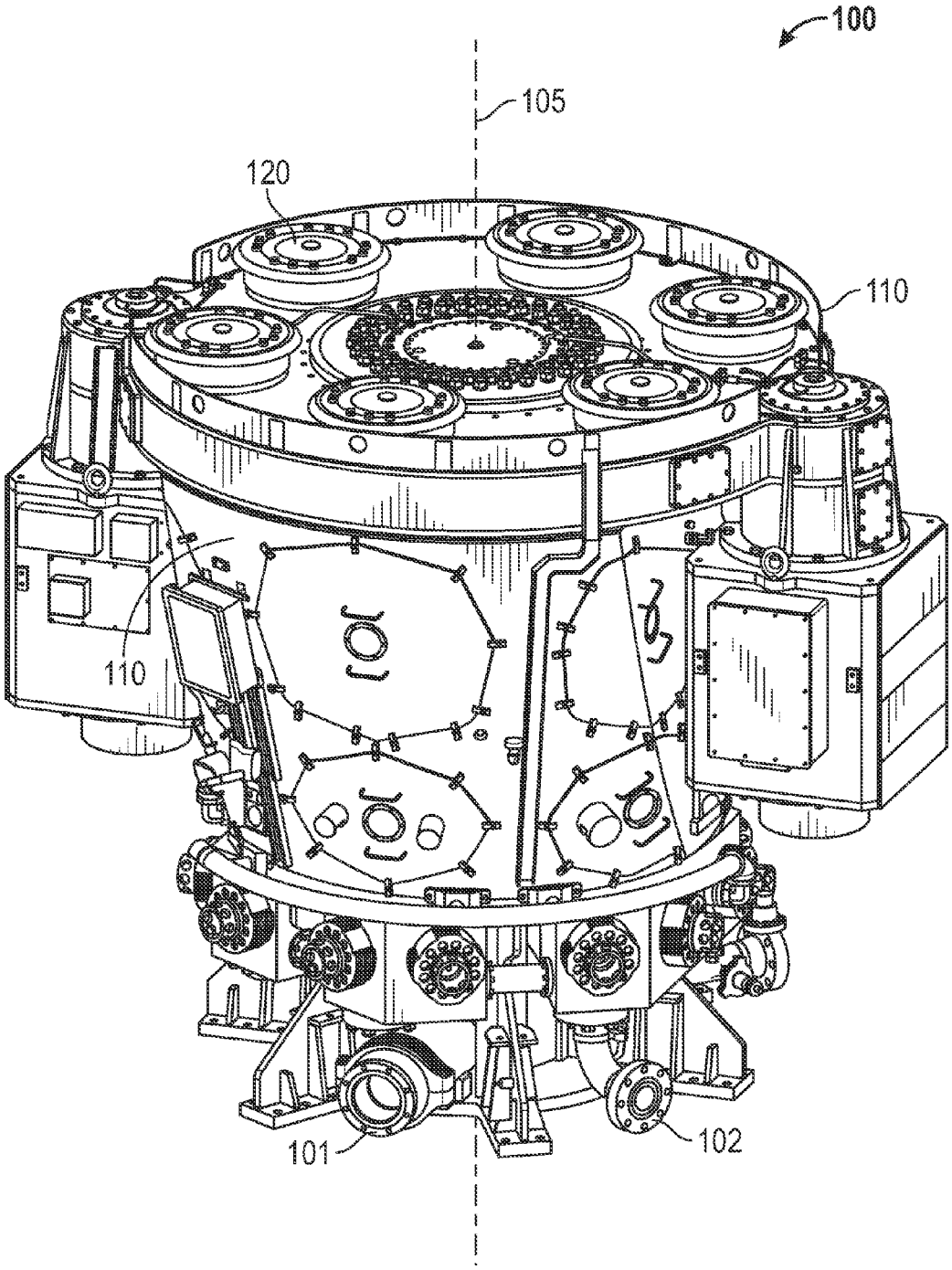
FIG. 1 is a perspective view of an embodiment of a mud pump in accordance with the principles described herein.

The following discussion is directed to various exemplary embodiments. However, one skilled in the art will understand that the examples disclosed herein have broad application, and that the discussion of any embodiment is meant only to be exemplary of that embodiment, and not intended to suggest that the scope of the disclosure, including the claims, is limited to that embodiment.

Certain terms are used throughout the following description and claims to refer to particular features or components. As one skilled in the art will appreciate, different persons may refer to the same feature or component by different names. This document does not intend to distinguish between components or features that differ in name but not function. The drawing figures are not necessarily to scale. Certain features and components herein may be shown exaggerated in scale or in somewhat schematic form and some details of conventional elements may not be shown in interest of clarity and conciseness.

In the following discussion and in the claims, the terms "including" and "comprising" are used in an open-ended fashion, and thus should be interpreted to mean "including, but not limited to . . . . " Also, the terms "couple" or "couples" are intended to mean either an indirect or direct connection. Thus, if a first device couples to a second device, that connection may be through a direct connection, or through an indirect connection via other devices, components, and connections. In addition, as used herein, the terms "axial" and "axially" generally mean along or parallel to a central axis (e.g., central axis of a body or a port), while the terms "radial" and "radially" generally mean perpendicular to the central axis. For instance, an axial distance refers to a distance measured along or parallel to the central axis, and a radial distance means a distance measured perpendicular to the central axis.

Figure 2:
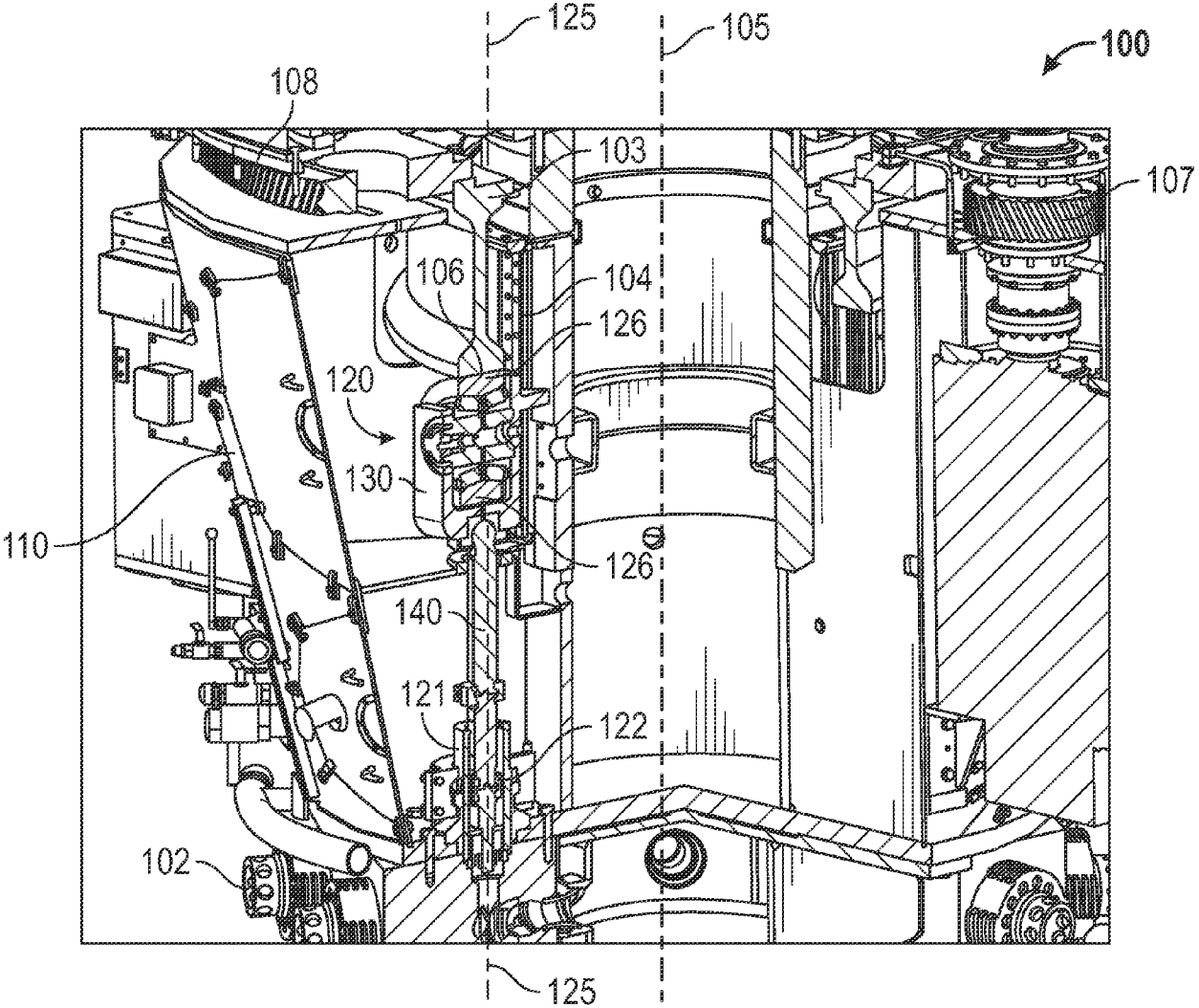
FIG. 2 is a perspective partial cut-away view of the mud pump of FIG. 1.

Referring now to FIGS. 1 and 2, an embodiment of a mud pump 100 for pumping drilling fluid during drilling operations is shown. In this embodiment, mud pump 100 has a central axis 105 and includes an outer body or housing 110 and a plurality of circumferentially-spaced pumping units or assemblies 120 disposed within housing 110. In particular, mud pump 100 includes six pumping assemblies 120, and thus, may also be referred to as a "hex" pump. In addition, mud pump 100 includes a drilling fluid inlet 101, a drilling fluid outlet 102 and an annular drive ring 103 that actuates pumping assemblies 120. Inlet 101 receives drilling fluid that has returned from the borehole and "cleaned" to remove contaminants and formation cuttings. The cleaned drilling fluid flows through inlet 101 and is distributed to pumping assemblies 120, which pressurize and pump the drilling fluid through outlet 102 into the drillstring.

Referring now to FIG. 2, each pumping assembly 120 has a central axis 125 oriented parallel to and radially spaced from axis 105. In this embodiment, each pumping assembly 120 includes a cylinder 121 mounted to housing 110, a piston 122 disposed within cylinder 121, a reciprocating member or coupling 130, and a connecting rod 140 extending axially between reciprocating member 130 and piston 122. An annular wheel or roller 126 is rotatably coupled to each reciprocating member 130. Each reciprocating member 130 is slidably mounted to an elongate, vertically oriented guide rail 104, which restricts the corresponding member 130 to axially up and down movement. In addition, each member 130 is biased upward to maintain the corresponding roller 126 in engagement with drive ring 103.

To operate pumping assemblies 120, drive ring 103 is rotated about axis 105 by a motor that rotates a pinion 107 intermeshing with an annular toothed ring 108 coupled to drive ring 103. Drive ring 103 has an axially undulating lower surface 106 that engages rollers 126. Thus, as drive ring 103 rotates about axis 105, lower surface 106 pushes rollers 126 and reciprocating members 130 axially downward and then allows rollers 126 and reciprocating members 130 to be biased back upward, thereby axially reciprocating rollers 126 and members 130 in a sequential manner. The axial reciprocation of rollers 126 and members 130 is translated to pistons 122 via connecting rods 140.

Figure 3:
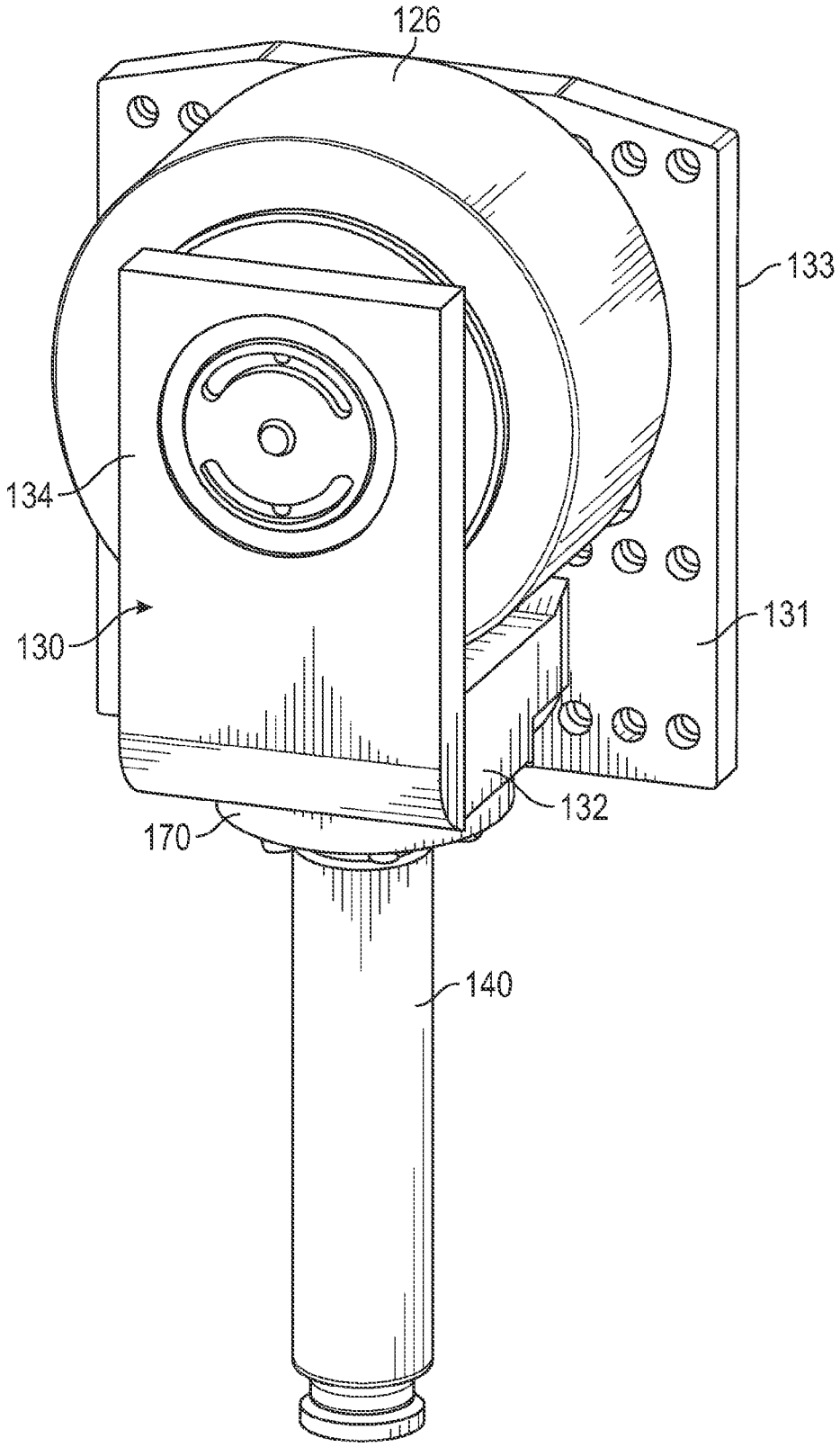
FIG. 3 is a perspective side view of the reciprocating member and the corresponding connecting rod of FIG. 2.
Figure 4:
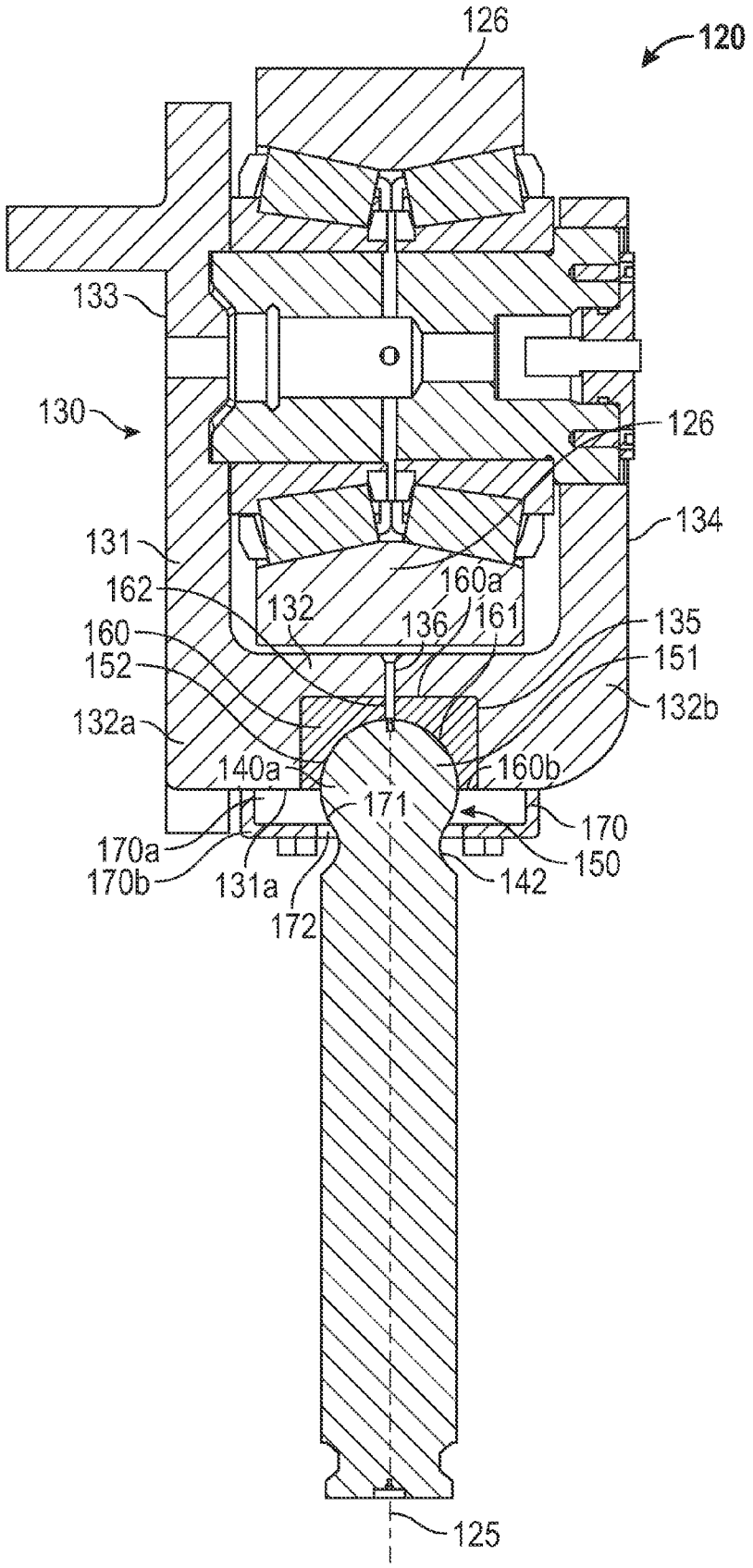
FIG. 4 is an end view of the reciprocating member and the corresponding connecting rod of FIG. 2.
Figure 5:
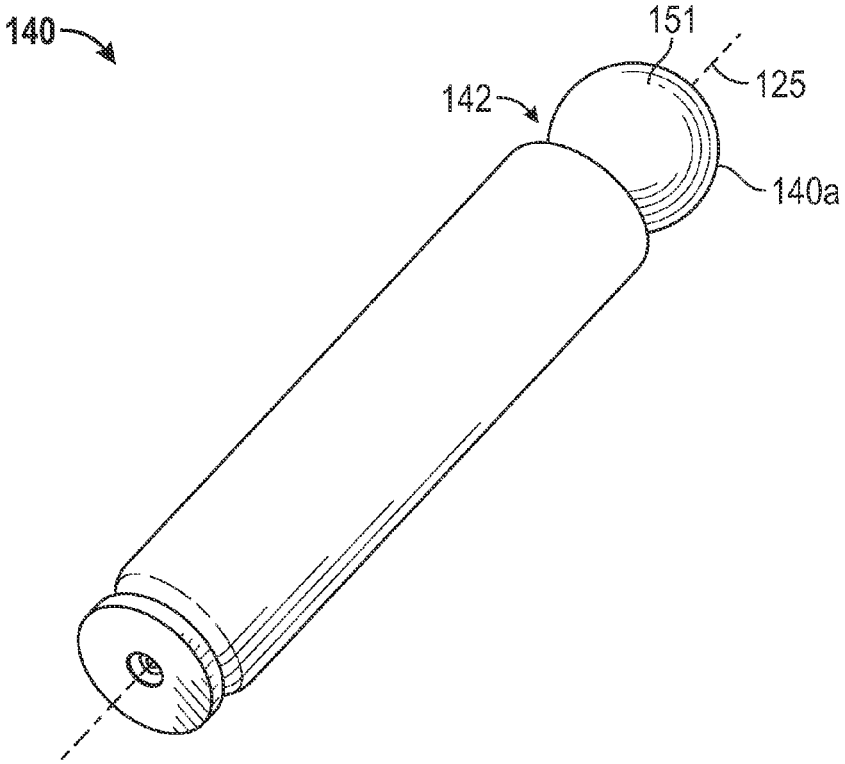
FIG. 5 is a perspective view of the connecting rod of FIG. 2.

Referring now to FIGS. 3-5, reciprocating member 130 and connecting rod 140 of one pumping assembly 120 will now be described it being understood that each pumping assembly 120 is configured the same. In this embodiment, connecting rod 140 is pivotally coupled to member 130 with a ball-and-socket joint 150. In particular, connecting rod 140 is coaxially aligned with axis 125 and has an upper end **140*a* comprising a spherical ball 151 and an annular recess 142 axially adjacent ball 151. Ball 151 is seated in and slidingly engaging a mating spherical socket 152 formed in reciprocating member 130 to form joint 150**.

Figure 6:
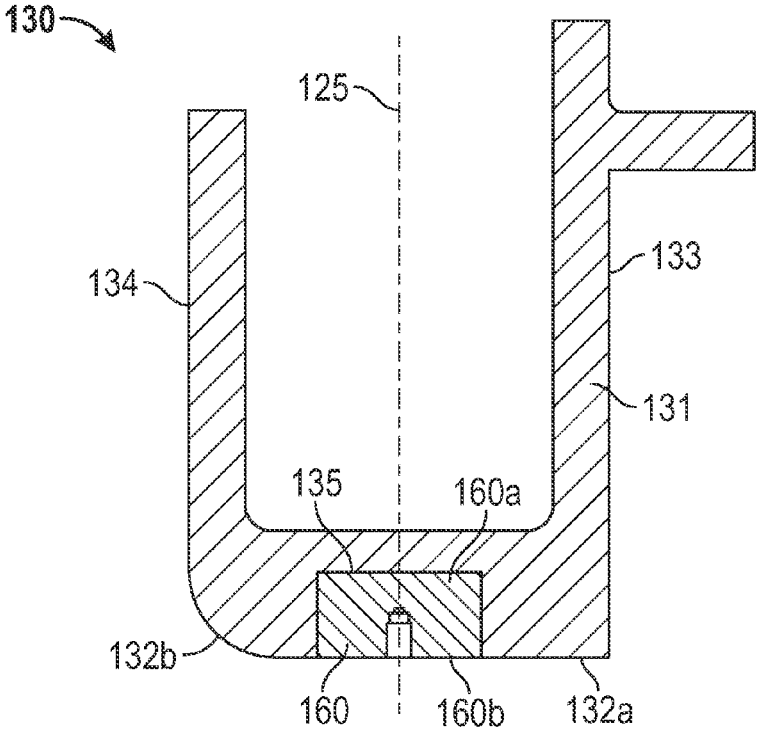
FIG. 6 is a cross-sectional view of the reciprocating member of FIG. 2.

Moving now to FIGS. 3, 4, and 6, in this embodiment, reciprocating member 130 comprises a generally u-shaped body 131, an insert 160 coupled to body 131, and a retention member 170 coupled to body 131. Body 131 includes a horizontal lower plate or base 132 defining a lower end **131*a* of body 131, a first vertical plate 133 extending perpendicularly upward from a first side 132*a* of base 132, and a second vertical plate 134 oriented parallel to first plate 133 and extending perpendicularly upward from a second side 132*b* of base 132. When reciprocating member 130 is disposed in pump 100, plate 133 is slidingly coupled to guide rail 104 and is radially inward of plate 134 relative to axis 105. Roller 126 is positioned between plates 133, 134 and rotates relative to body 131 about an axis oriented perpendicular to plates 133, 134**.

As best shown in FIGS. 4 and 6, base 132 includes a cylindrical counterbore or recess 135 extending axially upward from lower end 131*a*. In addition, in this embodiment, a lubrication port or bore 136 extends axially through base 132 from its upper surface to recess 135.

Figure 7:
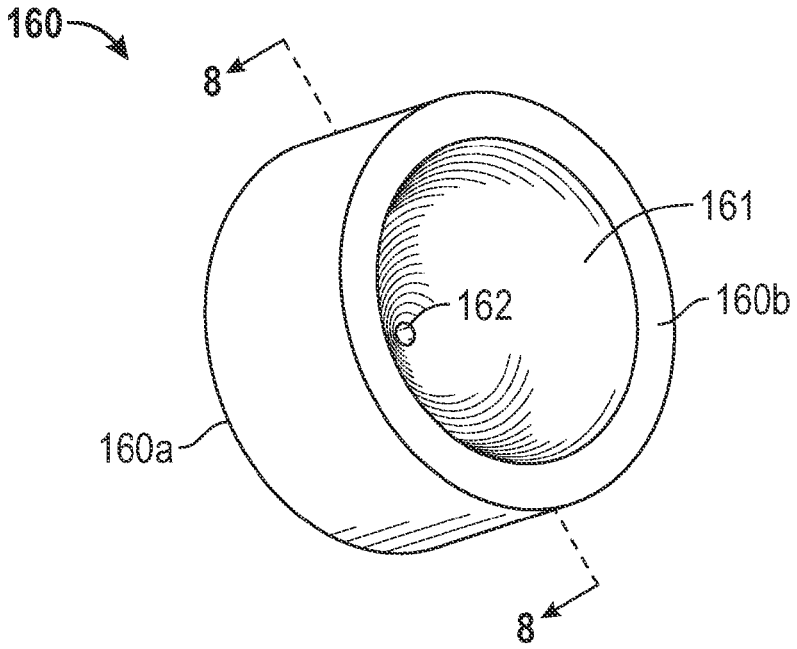
FIG. 7 is a perspective bottom view of the insert of FIG. 2.
Figure 8:
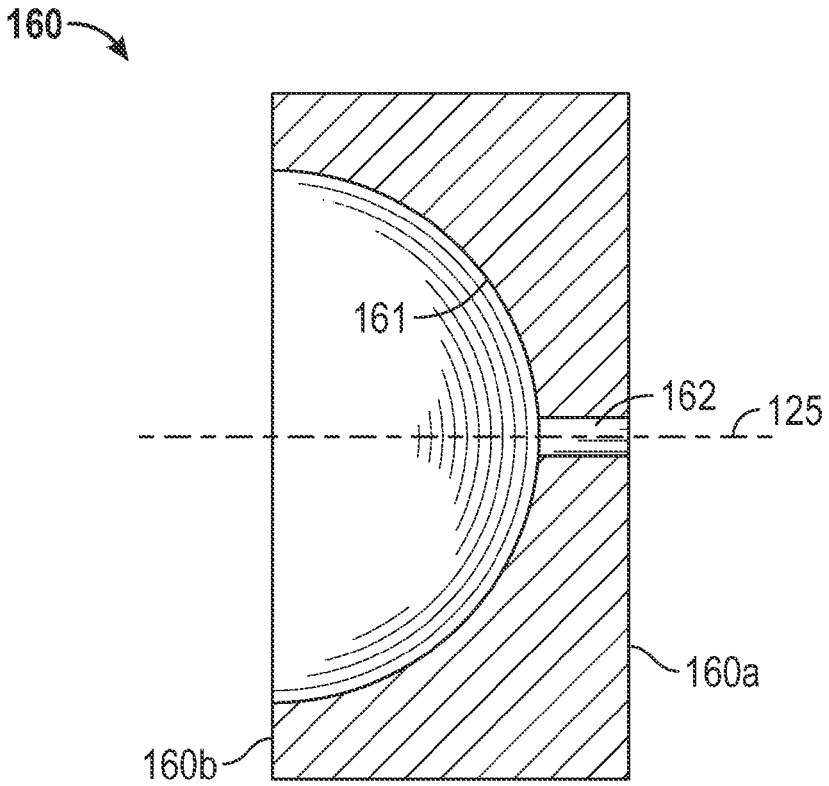
FIG. 8 is a cross-sectional view of the insert of FIG. 2.

Referring now to FIGS. 4, 7, and 8, insert 160 is seated in recess 135 and is coaxially aligned with axis 125. In this embodiment, insert 160 is a cylindrical member having a planar first or upper end 160*a* and a planar second or lower end 160*b* opposite end 160*a*. Lower end 160*b* includes a semi-spherical recess 161 that slidingly engages ball 151 and defines a portion of socket 152. Thus, ball 151 may more generally be described as a first component, and insert may be more generally described as a second component, wherein the first component slidingly engages the second component. In addition, insert 160 includes a lubrication port or bore 162 extending axially from upper end 160*a* to recess 161. As best shown in FIG. 4, when insert 160 is disposed in mating recess 135, bores 136, 162 are aligned and in fluid communication and lower end 160*b* is generally flush with lower end 131*a*. In this embodiment, bores 136, 162 define a flow passage for delivering lubricant to joint 150. However, in other embodiments, bores 136, 162 are eliminated and lubricant is not provided to joint 150.

Referring again to FIGS. 3 and 4, retention member 170 is mounted to lower end 131*a* of body 131, coaxially aligned with axis 125, and disposed about connecting rod 140. Retention member 170 is an annular member having a first or upper end 170*a* and a second or lower end 170*b*. Upper end 170*a* includes a semi-spherical recess 171 that slidingly engages ball 151 and defines a portion of socket 152. In addition, member 170 includes a through bore 172 extending axially from lower end 170*b* to recess 171.

As best shown in FIG. 3, together, semi-spherical recesses 161, 171 define spherical socket 152. With ball 151 seated in socket 152, connecting rod 140 extends downward through bore 172. Annular recess 142 is sized and positioned to allow connecting rod 140 to pivot to a limited extent about ball 151 before rod 140 impinges member 170.

As previously described, in some conventional mud pumps, the insert disposed between the reciprocating member and the connecting rod is made of bronze, which is susceptible to cracking resulting from the combination of thermal stress and compressive loads. However, to enhance the durability and operating lifetime of joints 150, and hence pump 100, in embodiments described herein, each insert 160 is made of a carbon-metal composite, and more specifically, a metal-reinforced carbon foam. Such a material offers the potential for reduced friction, and hence reduced friction induced thermal stress, upon sliding engagement with a ball 151 made of steel such as 17-4PH stainless steel.

The metal-reinforced carbon foam comprises an open cell carbon foam substrate that is infiltrated and saturated with a metal matrix. In general, an open cell foam (e.g., open cell carbon foam) comprises a plurality of bubble structures, each generally defined by about fourteen reticulated windows or facets. The polygonal opening through each open window is referred to as a "pore". In any given bubble, the polygonal pores actually are of two or three different characteristic sizes and shapes, but for material designation purposes, they are simplified to an average size and circular shape. The number of these pores that would subtend one inch then designates the foam "pore size" defined in terms of pores per inch (PPI).

Figure 9:
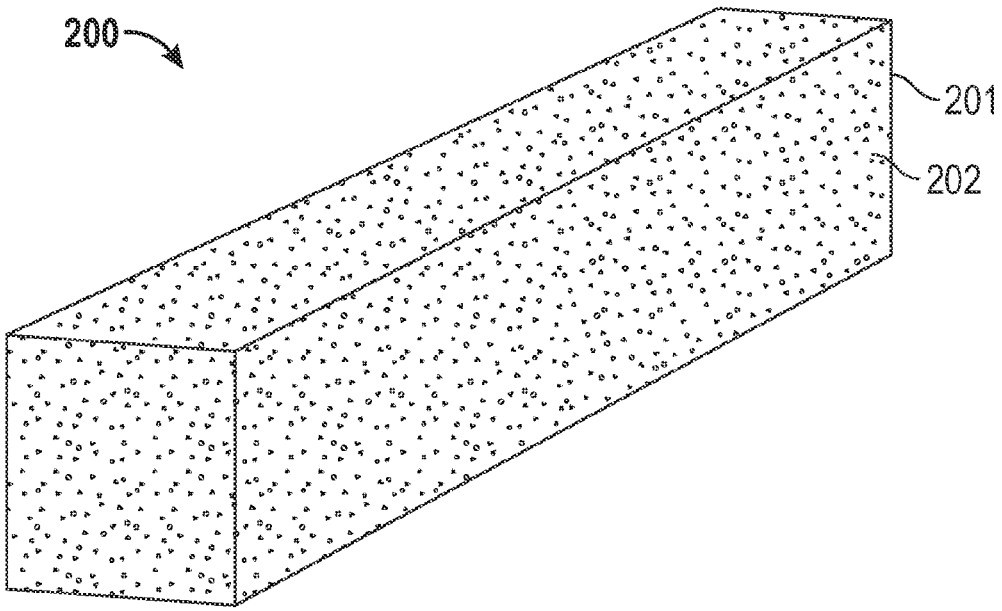
FIG. 9 is an enlarged perspective view of an open cell carbon foam material used to make the insert of FIGS. 7 and 8.

FIG. 9 illustrates a representative block 200 of the open cell carbon foam material prior to infiltration with a metal matrix. The open cell carbon foam includes a plurality of interconnected cells or pores 201 defined by and disposed between a network of interconnected struts 202. Pores 201 are dispersed throughout the entire volume of block 200. The interconnected open pores or cells 201 the carbon foam allows fluids, such as molten metal, to pass freely through the structure. The density of pores 201 in block 200 can be varied as desired, but preferably ranges from 5 to 100 pores per inch (PPI), and more preferably ranges from 10 to 50 PPI. A commercially available open cell carbon foam that can be used to form embodiments of insert 160 described herein is Duocel® Carbon Foam available from ERG Materials and Aerospace Corporation. In general, Duocel® Carbon Foams can be manufactured with any desired pore density within the range of 5 to 100 PPI. The average pore diameter is about 50% to 70% the diameter of its parent bubble, and thus, a 10 PPI foam would have roughly 5 to 7 bubbles per inch.

Figure 10:
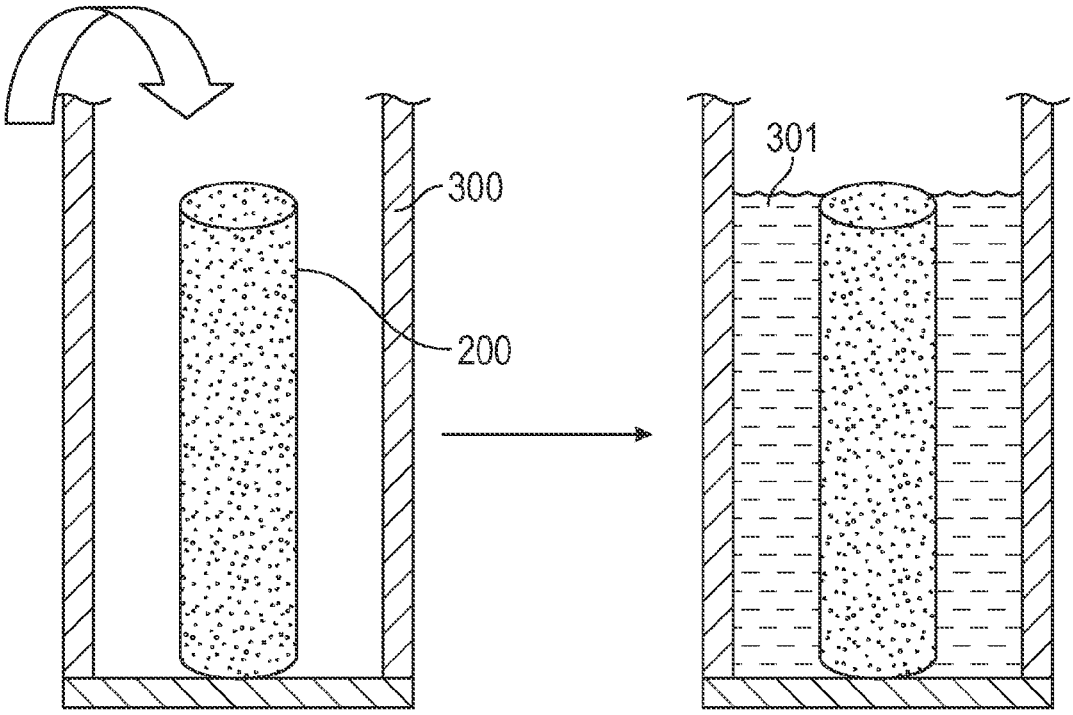
FIG. 10 is a schematic illustration of a system for forming the insert of FIGS. 7 and 8 using the open cell carbon foam material of FIG. 9 in a casting process.

Referring now to FIG. 10, as previously described, the metal-reinforced carbon foam that forms embodiments of insert 160 comprises an open cell carbon foam substrate that is infiltrated and saturated with a metal matrix. To manufacture insert 160, block 200 of open cell carbon foam material is placed inside a mold 300. Block 200 can be placed in the center of mold 300 or offset from the center of mold 300. In general, block 200 can be fabricated and pre-formed in any shape and size suitable for the casting process, and is preferably fabricated and pre-formed with a shape and size that simplifies and/or eliminates subsequent machining steps necessary to produce the desired geometry for insert 160. For example, block 200 can be pre-formed or fabricated in the form of a cylinder, handlebar, cube, rectangle, disk, ring, or other geometry before being placed inside mold 300.

Next, molten metal 301 is poured into mold 300 around block 200 of open cell carbon foam material. In general, the molten metal 301 can be any metal or metal alloy that provides the desired material properties in the anticipated application. To form insert 160 for use in mud pump 100, molten metal 301 is preferably 17-4PH stainless steel, 15-5PH stainless steel, 300 or 400-series stainless steel, bronze, or other metal or metal alloy capable of being cast and machined. Prior to pouring, the mold 300 and the block 200 can be pre-heated. The mold 300 can be pre-heated prior to the block 200 placement inside the mold, or can be pre-heated with the block 200 already placed in the mold. Block 200 may be pre-heated prior to placement in a pre-heated mold 300, or in a non-pre-heated mold 300. Upon pouring, molten metal 301 penetrates and infiltrates pores 201 throughout the block 200 of open cell carbon foam. In some embodiments, molten metal 301 is poured under vacuum to enhance migration throughout block 200 of open cell carbon foam, particularly in embodiments where pores 201 are relatively small (e.g., 40-50 ppi). Next, molten metal 301 is allowed to cool, thereby forming one solid machinable casting comprising a metal reinforced open cell carbon foam. After cooling, the finished casting can be cut and/or machined to form insert 160 of the desired size and shape. In addition, the finished casting may be heat treated as desired.

As previously described, in some conventional mud pumps, the insert disposed between the reciprocating member and the connecting rod is made of bronze, which is susceptible to cracking resulting from the combination of thermal stress and compressive loads. Thermal stress is typically induced by friction arising between the bronze insert and the connecting rod. However, in embodiments described herein, insert 160 made of metal reinforced open cell carbon foam provides a lower coefficient of friction (static and kinetic) than a bronze insert in connection with a connecting rod made of a given material (e.g., steel). In particular, the carbon of the open cell carbon foam functions similar to lubrication between insert 160 and ball 151 of connecting rod 130. Accordingly, embodiments described herein offer the potential for reduced friction and associated thermal stress as compared to conventional bronze inserts, thereby decreasing the potential for thermal stress induced thermal cracking.

While preferred embodiments have been shown and described, modifications thereof can be made by one skilled in the art without departing from the scope or teachings herein. The embodiments described herein are exemplary only and are not limiting. Many variations and modifications of the systems, apparatus, and processes described herein are possible and are within the scope of the invention. For example, the relative dimensions of various parts, the materials from which the various parts are made, and other parameters can be varied. Accordingly, the scope of protection is not limited to the embodiments described herein, but is only limited by the claims that follow, the scope of which shall include all equivalents of the subject matter of the claims. Unless expressly stated otherwise, the steps in a method claim may be performed in any order. The recitation of identifiers such as (a), (b), (c) or (1), (2), (3) before steps in a method claim are not intended to and do not specify a particular order to the steps, but rather are used to simplify subsequent reference to such steps.

What is claimed is:

1. An apparatus, comprising:

a first component;

an insert seated in a recess in the first component, wherein the insert is made of a casting comprising an open cell carbon foam and a metal dispersed throughout a plurality of interconnected pores in the open cell carbon foam, wherein the metal comprises at least one of bronze or steel;

a second component slidingly engaging the insert, wherein the second component is made of steel.

2. The apparatus of claim 1, wherein the first component is a reciprocating member and the second component is a connecting rod;

wherein the insert includes a semi-spherical recess and the connecting rod has a spherical ball at a first end that is seated in the recess.

3. The apparatus of claim 2, wherein the connecting rod has a second end opposite the first end, wherein the second end is coupled to a piston disposed in a cylinder.

4. The apparatus of claim 1, wherein the plurality of pores have a density between 5 ppi and 100 ppi.

5. The apparatus of claim 2, wherein the density of pores is between 10 ppi and 30 ppi.

6. A pump for pumping drilling fluid, the pump comprising:

a housing;

a plurality of pumping assemblies disposed within the housing, wherein each pumping assembly includes:

a cylinder coupled to the housing;

a piston disposed within the cylinder;

a reciprocating member including a body and an insert seated in a counterbore in the body, wherein the insert includes a semi-spherical recess;

a connecting rod having a first end coupled to the piston and a second end comprising a spherical ball slidingly engaging the semi-spherical recess of the insert;

wherein the insert is made of a casting comprising a metal reinforced open cell carbon foam;

at least one drilling fluid inlet configured to distribute drilling fluid to the pumping assemblies; and at least one drilling fluid outlet configured to supply pressurized drilling fluid from the pumping assemblies.

7. The pump of claim 6, wherein the metal reinforced open cell carbon foam comprises an open cell carbon foam and a metal dispersed throughout a plurality of interconnected pores in the open cell carbon foam, wherein the metal comprises at least one of bronze or steel.

8. The pump of claim 7, wherein the spherical ball is made of steel.

9. The pump of claim 7, further comprising a ring rotatably coupled to the housing, wherein the ring engages a roller rotatably coupled to each reciprocating member and is configured to axially reciprocate the reciprocating members and the pistons.

10. The pump of claim 7, wherein the plurality of pores have a density between 5 ppi and 100 ppi.

11. The pump of claim 10, wherein the density of pores is between 10 ppi and 30 ppi.

* * * * *